US011867056B2

(12) United States Patent
Sartori et al.

(10) Patent No.: US 11,867,056 B2
(45) Date of Patent: Jan. 9, 2024

(54) UNDERGROUND DRILL

(71) Applicant: THE TORO COMPANY, Bloomington, MN (US)

(72) Inventors: Stephen Joseph Sartori, Bloomington, MN (US); Mark Paul Manteufel, Bloomington, MN (US); Lee Evan von Lehe, Saint Paul, MN (US)

(73) Assignee: THE TORO COMPANY, Bloomington, MN (US)

( * ) Notice: Subject to any disclaimer, the term of this patent is extended or adjusted under 35 U.S.C. 154(b) by 0 days.

(21) Appl. No.: 17/474,376

(22) Filed: Sep. 14, 2021

(65) Prior Publication Data

US 2021/0404259 A1 Dec. 30, 2021

Related U.S. Application Data

(62) Division of application No. 16/564,117, filed on Sep. 9, 2019, now abandoned.

(60) Provisional application No. 62/738,075, filed on Sep. 28, 2018.

(51) Int. Cl.

| | |
|---|---|
| ***E21B 7/04*** | (2006.01) |
| ***E21B 19/15*** | (2006.01) |
| ***E21B 19/20*** | (2006.01) |

(52) U.S. Cl.

CPC ..... *E21B 7/046* (2013.01); *E21B 19/15* (2013.01); *E21B 19/20* (2013.01)

(58) Field of Classification Search

CPC ..... E21B 19/14; E21B 19/15; E21B 19/20; E21B 7/046

USPC ..... 175/52, 85

See application file for complete search history.

(56) References Cited

U.S. PATENT DOCUMENTS

| | | | |
|---|---|---|---|
| 4,422,794 | A | 12/1983 | Deken |
| 4,945,999 | A | 8/1990 | Malzahn |
| 4,953,638 | A | 9/1990 | Dunn |
| 5,070,948 | A | 12/1991 | Malzahn et al. |
| 5,148,880 | A | 9/1992 | Lee et al. |
| 5,242,026 | A | 9/1993 | Deken et al. |
| 5,556,253 | A | 9/1996 | Rozendaal et al. |
| 5,607,280 | A | 3/1997 | Rozendaal |
| 5,944,121 | A | 8/1999 | Bischel et al. |
| 6,079,506 | A | 6/2000 | Mercer |
| 6,085,852 | A | 7/2000 | Sparks et al. |
| 6,179,065 | B1 | 1/2001 | Payne et al. |
| 6,315,062 | B1 | 11/2001 | Alft et al. |

(Continued)

OTHER PUBLICATIONS

DD-110 Operation & Safety, Instruction Manual; Manual Part No. 7053-0031. American Augers, A Charles Machine Works Company, West Salem, Ohio. Released Feb. 2021, Revision 00. 154 pages.

(Continued)

*Primary Examiner* — Frederick L Lagman

(74) *Attorney, Agent, or Firm* — Mueting Raasch Group

(57) ABSTRACT

An underground drill comprising a frame, a drill carriage, an anchor assembly, a multi-axis input device, an electronic controller, and a mode selector. The drill carriage and the anchor assembly are operably connected to the frame. The electronic controller is configured to receive input from the multi-axis input device and produce a corresponding output signal. The mode selector has an anchor mode, wherein the output signal actuates the anchor assembly, and a drill mode, wherein the output signal actuates the drill carriage.

6 Claims, 9 Drawing Sheets

(56) References Cited

U.S. PATENT DOCUMENTS

| | | | | |
|---|---|---|---|---|
| 6,332,502 | B1 | 12/2001 | Mills et al. | |
| 6,357,537 | B1 | 3/2002 | Runquist et al. | |
| 6,360,830 | B1 | 3/2002 | Price | |
| 6,374,928 | B1 | 4/2002 | Teller et al. | |
| 6,408,954 | B1 | 6/2002 | Price et al. | |
| 6,474,931 | B1 | 11/2002 | Austin et al. | |
| 6,474,932 | B1 | 11/2002 | Rush | |
| 6,533,046 | B2 | 3/2003 | Mills et al. | |
| 6,543,551 | B1 | 4/2003 | Sparks et al. | |
| 6,550,547 | B1 | 4/2003 | Payne et al. | |
| 6,814,164 | B2 | 11/2004 | Mills et al. | |
| 6,845,825 | B2 | 1/2005 | Bischel et al. | |
| 6,910,541 | B2 | 6/2005 | Kelpe | |
| 7,011,166 | B2 | 3/2006 | Koch et al. | |
| 7,018,164 | B2 | 3/2006 | Anthis et al. | |
| 7,240,742 | B2 | 7/2007 | Sewell et al. | |
| 7,284,624 | B2 | 10/2007 | Tjader | |
| 7,467,670 | B2 | 12/2008 | Hartke et al. | |
| 7,562,724 | B2 | 7/2009 | Allred et al. | |
| 7,600,584 | B2 | 10/2009 | Sewell et al. | |
| 7,694,751 | B2 | 4/2010 | Hartke | |
| 8,136,612 | B2 | 3/2012 | Carlson et al. | |
| 8,151,906 | B2 | 4/2012 | Salins et al. | |
| 8,235,142 | B2 | 8/2012 | Carlson et al. | |
| 9,127,518 | B1 * | 9/2015 | Sewell | E21B 19/20 |
| 10,995,601 | B2 * | 5/2021 | Guertin | E21B 44/00 |
| 2002/0153169 | A1 | 10/2002 | Sewell | |
| 2003/0063013 | A1 | 4/2003 | Jin et al. | |
| 2003/0205409 | A1 | 11/2003 | Koch et al. | |
| 2010/0139982 | A1 | 6/2010 | Carlson et al. | |
| 2011/0112728 | A1 | 5/2011 | Stacy, II | |
| 2011/0174545 | A1 | 7/2011 | Hartke et al. | |
| 2013/0106167 | A1 | 5/2013 | Wilmer et al. | |
| 2017/0190356 | A1 | 7/2017 | Szalko et al. | |
| 2018/0313157 | A1 | 11/2018 | Langenfeld et al. | |
| 2018/0363443 | A1 | 12/2018 | Guertin et al. | |
| 2020/0102791 | A1 | 4/2020 | Sartori et al. | |
| 2020/0199940 | A1 | 6/2020 | Auer et al. | |
| 2020/0284108 | A1 | 9/2020 | Jostes et al. | |

OTHER PUBLICATIONS

JT40/JT40 All Terrain HRC and LRC, Operator's Manual. Issue 1.0. The Charles Machine Works, Inc., Perry, OK. Available at least as early as 2017. 267 pages.

NPL Document 1, American Augers Horizontal Directional Drill Model DD-110, Depiction of two functional joystick mode selections. Available at least as early as 2016; 1 page.

U.S. Appl. No. 62/738,075, filed Sep. 28, 2018 titled Underground Drill (no copy submitted).

* cited by examiner

UNDERGROUND DRILL

This application is a divisional application of U.S. patent application Ser. No. 16/564,117, filed Sep. 9, 2019 (abandoned), which claims the benefit of U.S. Provisional Patent Application No. 62/738,075, filed Sep. 28, 2018, the content of each of which is incorporated herein by reference in its entirety.

Embodiments of the present disclosure relate generally to underground drilling and, more particularly, to various operations related to horizontal underground directional drills.

BACKGROUND

Underground drills are well known for steerable underground drilling, typically described as Horizontal Directional Drills (HDD). Often times, horizontal directional drills comprise an anchor mechanism, a drill mechanism and a pipe loading mechanism. Separate controls are commonly provided for anchor operations and drill operations. The anchor and drill controls often operate in dissimilar manners and reside in separate locations. Furthermore, the task of manually loading a drill pipe into an HDD is often complicated and time-consuming. Therefore, a drill with improvements in these areas is desirable.

SUMMARY

One aspect of the present disclosure relates to an underground directional drill comprising a frame, a drill carriage, an anchor assembly, a multi-axis input device, an electronic controller, and a mode selector. The drill carriage assembly and the anchor assembly are operably connected to the frame. The electronic controller is configured to receive a signal from the multi-axis input device and produce a corresponding output signal. The mode selector has an anchor mode, wherein the output signal actuates the anchor assembly, and a drill mode, wherein the output signal actuates the drill carriage assembly.

Another aspect of the present disclosure relates to an underground directional drill comprising a frame, a drill spindle, a pipe rack, and a pipe loading frame. The drill spindle, pipe rack, and pipe loading frame are operably connected to the frame. The pipe loading frame is movable between a manual loading position and a drill string position. A pipe positioned in the pipe loading frame maintains continuous contact with the pipe loading frame during movement of the pipe loading frame between the manual loading position and the drill string position.

In still another aspect, the present disclosure relates to a method of loading a pipe into an underground directional drill. The method comprises providing an underground directional drill and a pipe, wherein the drill comprises a pipe loading frame movable between a manual loading position and a drill string position. The pipe loading frame is positioned in the manual loading position and a pipe is placed into a pipe receiver associated with the pipe loading frame. The pipe loading frame is moved to a drill string position. The pipe maintains continuous contact with the pipe receiver as the pipe loading frame moves from the manual loading position to the drill string position.

BRIEF DESCRIPTION OF THE VIEWS OF THE DRAWING

Embodiments of the present disclosure will be described hereafter in the Detailed Description of Exemplary Embodiments section, taken in conjunction with the following drawing, in which like reference numerals refer to like elements or parts throughout, wherein:

FIGS. 6A through 6C are front cross-sectional views of the drill of FIG. 1, illustrating positions of the pipe loading assembly of FIGS. 4 and 5, in accordance with embodiments of this disclosure; wherein FIG. 6A illustrates the pipe loading assembly in a manual pipe loading position, FIG. 6B illustrates the pipe loading assembly in a position below a pipe rack and FIG. 6C illustrates the pipe loading assembly in a position wherein a pipe and a drill spindle are in coaxial alignment.

Figure 1:
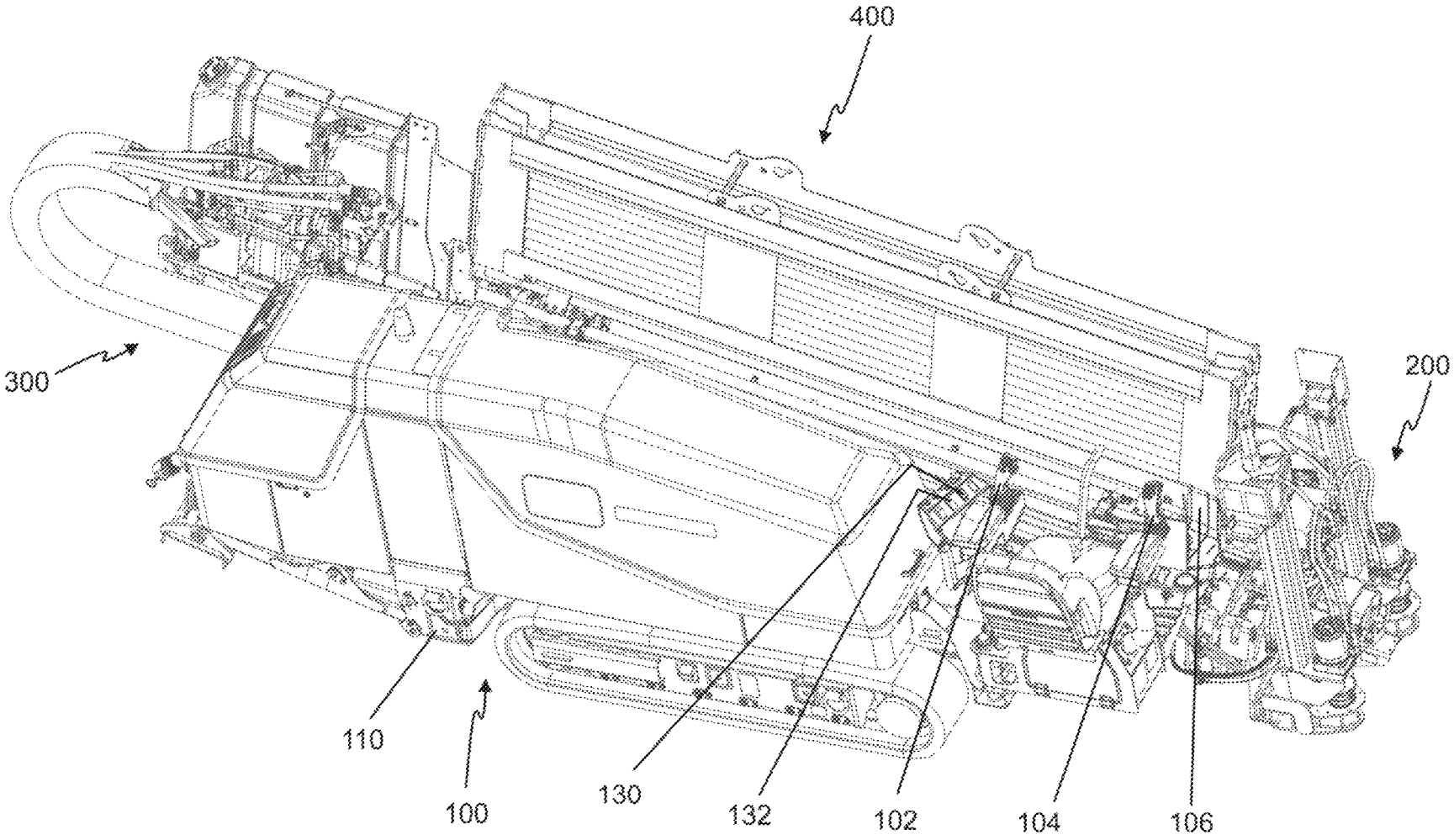
FIG. 1 is a perspective view of an underground directional drill in accordance with one embodiment of the disclosure.

The figures are rendered primarily for clarity and, as a result, are not necessarily drawn to scale. Moreover, various structure/components, including but not limited to fasteners, electrical components (wiring, cables, etc.), and the like, may be shown diagrammatically or removed from some or all of the views to better illustrate aspects of the depicted embodiments, or where inclusion of such structure/components is not necessary to an understanding of the various exemplary embodiments described herein. The lack of illustration/description of such structure/components in a particular figure is, however, not to be interpreted as limiting the scope of the various embodiments in any way.

DETAILED DESCRIPTION OF EXEMPLARY EMBODIMENTS

In the following detailed description of illustrative embodiments, reference is made to the accompanying figures of the drawing which form a part hereof. It is to be understood that other embodiments, which may not be described and/or illustrated herein, are certainly contemplated.

Embodiments of the present disclosure relate generally to underground horizontal directional drills that may control an anchor system and rod loading system with a multi-axis input device. Additionally, the input device may be used for controlling both the anchor system and the drill carriage (thrust and rotation). Such features may provide a directional drill with increased utility and convenience.

All headings provided herein are for the convenience of the reader and should not be used to limit the meaning of any text that follows the heading, unless so specified. Moreover, unless otherwise indicated, all numbers expressing quantities, and all terms expressing direction/orientation (e.g., vertical, horizontal, parallel, perpendicular, etc.) in the specification and claims are to be understood as being modified in all instances by the term "about."

It is noted that the terms "comprises" and variations thereof do not have a limiting meaning where these terms appear in the accompanying description and claims. Further, "a," "an," "the," "at least one," and "one or more" are used interchangeably herein. Moreover, relative terms such as "left," "right," "front," "fore," "forward," "rear," "aft,"

"rearward," "top," "bottom," "side," "upper," "lower," "above," "below," "horizontal," "vertical," and the like may be used herein and, if so, are from the perspective of one operating the directional drill while the drill is in a typical operating configuration (see, e.g., FIG. 1.) These terms are used only to simplify the description, however, and not to limit the interpretation of any embodiment described.

With reference to the figures of the drawing, wherein like reference numerals designate like parts and assemblies throughout the several views, FIGS. 1-6C illustrate an underground directional drill 100 according to embodiments of this disclosure.

Referring to FIG. 1, directional drill 100 is depicted in a typical operating configuration and includes a frame 110 operably connected to: a multi-axis input device 102, a mode selector 106, an anchor assembly 200, a drill carriage assembly 300 and a pipe loading assembly 400. Drill 100 may have a prime mover (e.g., internal combustion engine, electric motor, etc.; not shown) operably connected to the frame 110. Anchor assembly 200 secures drill 100 by drilling anchor posts 208,218 into the ground, thereby minimizing movement of the drill 100 during operation (see FIG. 2). Drill carriage 300 is responsible for providing the thrust and rotation required to drill horizontally in the ground. Drill assembly 100 further comprises a second multi-axis input device 104, but other embodiments may only require a single multi-axis input device. Multi-axis input devices 102,104 may be a joystick, mouse, 3D controller, 3D motion controller, or other mechanism which may translate physical movement along at least two axes into an output signal.

Mode selector 106 may include or be connected to a controller adapted to monitor and control various functions. For example, an electronic system controller 134 receives input (e.g., one or more signals) through actuation of input devices 102,104 and, depending on the mode selected in mode selector 106, controller 134 will process the input and output a corresponding signal to actuate either the drill carriage assembly 300 or the anchor assembly 200 (see FIG. 7). Alternatively, a controller may reside in a separate or remote location. "Output signal," as used herein, may be an electronic signal that may be transmitted to other electronic components (e.g., electromechanical valves, system controller, etc.). Alternatively, "output signal" may be physical movement of one or more linkages connected to, for example, a hydraulic valve. Controller 134 may include a processor (not shown) configured to receive various inputs and executes one or more computer programs or applications stored in memory. The memory may include computer-readable instructions or applications that, when executed, e.g., by the processor, cause the controller to perform various calculations and/or issue commands or signals. That is to say, the processor and memory may together define a computing assembly operable to process input data and generate the desired output signal to one or more components/devices. The controller 134 may receive various input data including signals from input devices 102,104, switch 132, and mode selectors 106,130 and generate corresponding commands or signals to cause the drill carriage 300, anchor assembly 200, or pipe loading assembly 400 to move or actuate. Furthermore, the controller 134 output signal may be mechanical, electric or hydraulic. In one embodiment, mode selector 106 includes a display with input buttons and a graphical user interface.

Figure 2:
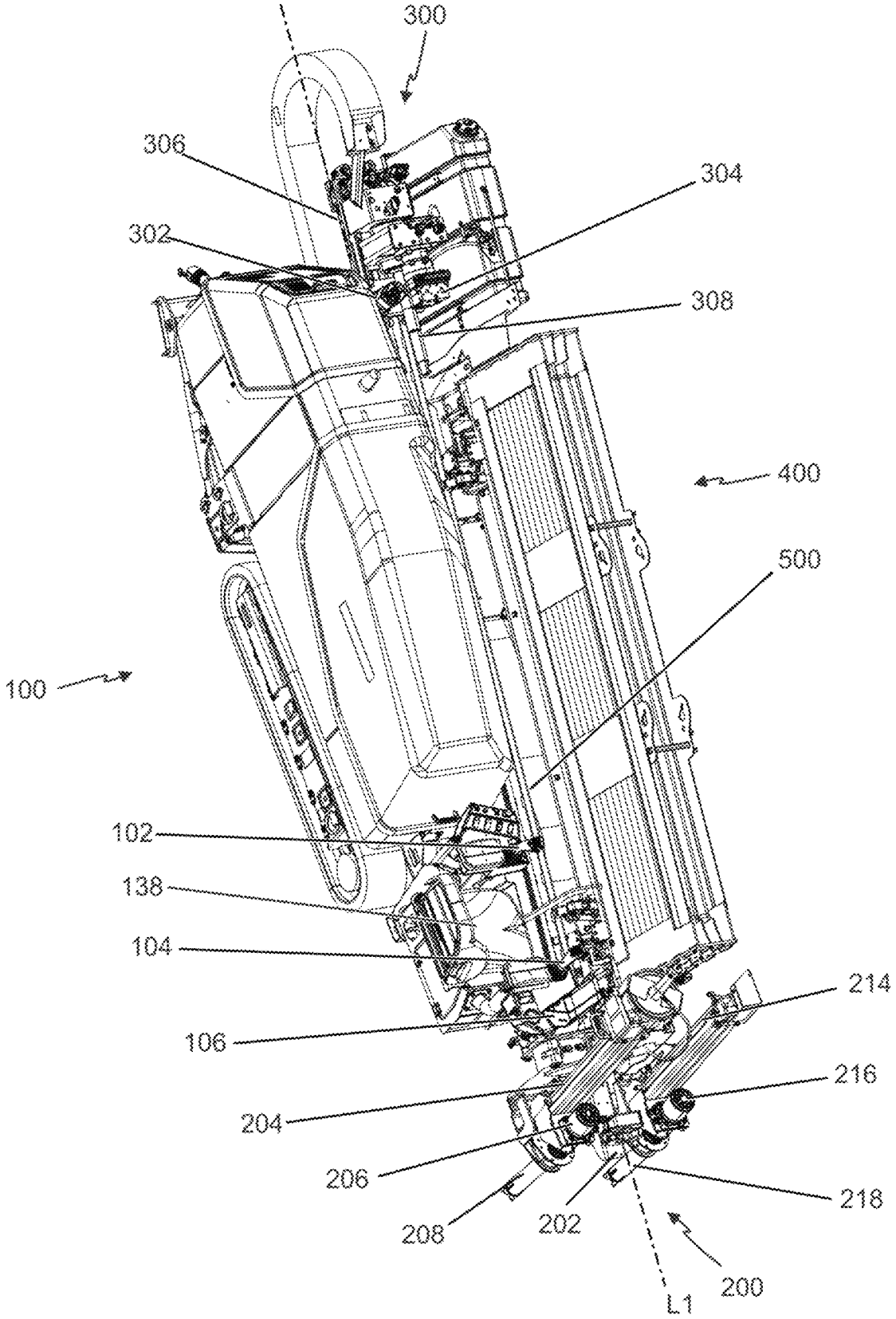
FIG. 2 is a top perspective view of the drill of FIG. 1, illustrating a drill carriage, an anchor mechanism, and multi-axis controls.

With reference now to FIG. 2, drill 100 is depicted in a top-perspective view. Anchor assembly 200 is operably connected to an anchor frame 202, which is supported by the frame 110 (see FIG. 1). Anchor frame 202, in some embodiments, operably supports: a first thrust generator 204, a second thrust generator 214, a first torque generator 206, a second torque generator 216, a first anchor post 208, and a second anchor post 218. Thrust generator 204 may have a first portion or end connecting to frame 202 and a second portion or end connecting to a first end of torque generator 206. Likewise, thrust generator 214 may have a first end connecting to frame 202 and a second end connecting to a first end of torque generator 216. The second ends of torque generators 206,216 may connect to respective anchor posts 208,218. Alternatively, anchor assembly 200 may include a single or three or more thrust generator(s), torque generator (s) and anchor post(s). In drill 100, thrust generators 204,214 are linear hydraulic actuators. Alternatively, thrust generators may be of another variety, such as an electrical motor paired with a mechanical system (e.g., worm gear, rack and pinion, screw, or draw bolt). In one embodiment, torque generators 206,216 are rotary hydraulic motors, but may alternatively be another type of torque generator, such as an electric motor with or without a transmission. In one embodiment, extension of thrust generators 204,214 and actuation of torque generators 206,216 will cause posts 208,218 to rotate and lower into the ground. In other words, simultaneous actuation of generators 204,214,206,216 may drill posts 208,218 into the ground. Input devices 102,104 may be horizontally spaced 24 inches or greater from anchor posts 208,218.

Drill carriage assembly 300 is supported by frame 110 and operably supports: one or more (e.g., two) carriage thrust generators 302 (only one visible), a carriage torque generator 304, a carriage frame 306, and a drill spindle 308. Thrust generators 302 are secured to carriage frame 306 and arranged on opposing sides of a thrust rack 500. Thrust generators 302, when actuated, rotate pinion gears along thrust rack 500. In other words, thrust rack 500 is a longitudinal track, having opposing rack gears, along which the carriage frame 306 translates by way of thrust generators 302. The longitudinal direction of drill 100 is identified as L1 (see FIG. 2). Torque generator 304 comprises a first end connected to the carriage frame 306 and a second end in communication with drill spindle 308. When actuated, torque generator 304 rotates drill spindle 308. In one embodiment, torque generator 304 and thrust generators 302 are hydraulic motors, but may alternatively be another type of torque generator, such as an electric motor with or without a transmission.

Figure 3:
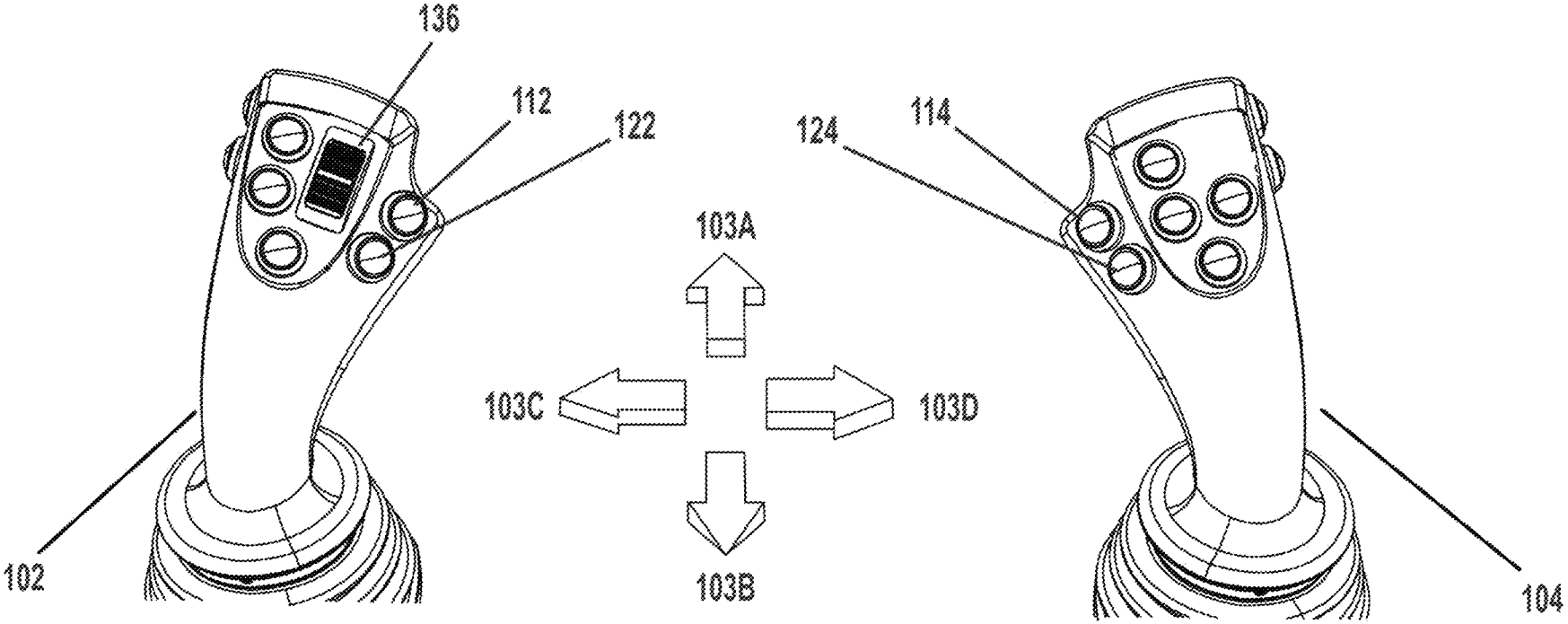
FIG. 3 is an isolated, enlarged view of multi-axis input devices, in accordance with embodiments of the disclosure.

FIG. 3 is a perspective view of multi-axis input devices 102,104. Input devices 102,104 are both configured to move independently in directions 103A, 103B, 103C, 103D and combinations thereof. In utilizing drill 100, an operator may select a mode, using mode selector 106 (see FIG. 1). Alternatively, modes may be selected using a remote mode selector 130 (see also FIG. 1). Two main categories of modes are contemplated, anchor modes and drill modes.

A first anchor mode selected by mode selector 106 may direct output signals from the input devices 102,104 to actuate (via the controller 134) the anchor assembly 200. In one embodiment, controller 134 may require an operator to be seated in seat 138 prior to sending an output signal to the anchor assembly 200 (see FIG. 2). In this first anchor mode, a movement of right (from the view of the operator) input device 104 may control right generators 204,206 and post 208; and movement of left input device 102 may control left generators 214,216 and post 218. In this first anchor mode, moving input device 104 in direction 103A may actuate thrust generator 204 to thrust post 208 into the ground, whereas moving input device 104 in direction 103B may actuate thrust generator 204 to raise post 208 out of the ground. Furthermore, moving input device 104 in direction 103C may actuate torque generator 206 to rotate post 208 in a counter-clockwise direction, whereas moving input device 104 in direction 103D may actuate torque generator 206 to rotate post 208 in a clockwise direction. Likewise, moving input device 102 in direction 103A will actuate thrust generator 214 to lower post 218, moving input device 102 in direction 103B will actuate thrust generator 214 to raise post 218, moving input device 102 in direction 103C will actuate torque generator 216 to rotate post 218 in a counter-clockwise direction, and moving input device 102 in direction 103D will actuate torque generator 216 to rotate post 218 in a clockwise direction. Alternatively, movement of input devices 102,104 in any direction may be configured to perform any of the above-described movements of posts 208,218. Input devices 102,104 may output a signal responsive to the amount of displacement of input devices 102,104. For example, the output signal of input device 102, may be proportional to the displacement of input device 102. However, other embodiments may employ other correlations between the amount of input device displacement and the output signal.

Additional anchor modes are contemplated, which allow input devices 102,104 to control generators in temporal succession. For example, a second anchor mode may have a first state and a second state, wherein the first state will cause input device 102 to control generators 204,206 and the second state will cause input device 102 to control generators 214,216. Upon entering the second anchor mode, mode selector 106 may default to a pre-determined state and a transition to the other state may be made through mode selector 106. Alternatively, the state transition may be conducted through actuation of a switch 112 on input device 102. A third anchor mode is contemplated, which may carry out the function described in the second anchor mode, but using input device 104 and switch 114, in place of input device 102 and switch 112.

A fourth anchor mode is also contemplated, wherein one input device controls a thrust generator and the other input device controls a torque generator. For example, in this fourth anchor mode and in a first state, input device 102 may control thrust generator 214 and input device 104 may control torque generator 216. In the fourth anchor mode and in a second state, input device 102 may control thrust generator 204 and input device 104 may control torque generator 206. A state transition in the fourth anchor mode may be conducted through mode selector 106 or, alternatively, through switches 112, 114. Alternatively, input device 102 may control generators 206,216 and input device 104 may control generators 204,214.

In a drill mode, output signals from the input devices 102,104 may be directed to actuate the drill carriage assembly 300. In a first drill sub-mode, input device 102 may control both thrust generators 302 and torque generator 304. For example, movement of input device 102 in directions 103C,103D may actuate thrust generators 302, thereby translating the drill carriage along thrust rack 500, and movement of input device 102 in directions 103A,103B may actuate torque generator 304, thereby rotating the drill spindle 308. In a second drill sub-mode, both input devices 102,104 may be utilized to control the actuation of the drill carriage assembly in combination. For example, movement of input device 102 may actuate or control torque generator 304, which rotates drill spindle 308, and movement of input device 104 may actuate or control thrust generators 302, which translates drill carriage assembly 300 along thrust rack 500. Upon entering the drill mode, the mode selector 106 may default to a pre-determined sub-mode and a transition to the other sub-mode may be made through actuation in the mode selector 106. Alternatively, the state transition may be conducted through actuation of switches 122,124 on input devices 102,104. Furthermore, movement of input devices 102,104 in any direction may be configured to perform any of the above-described movements of drill carriage 300 translation and drill spindle 308 rotation.

Figure 4:
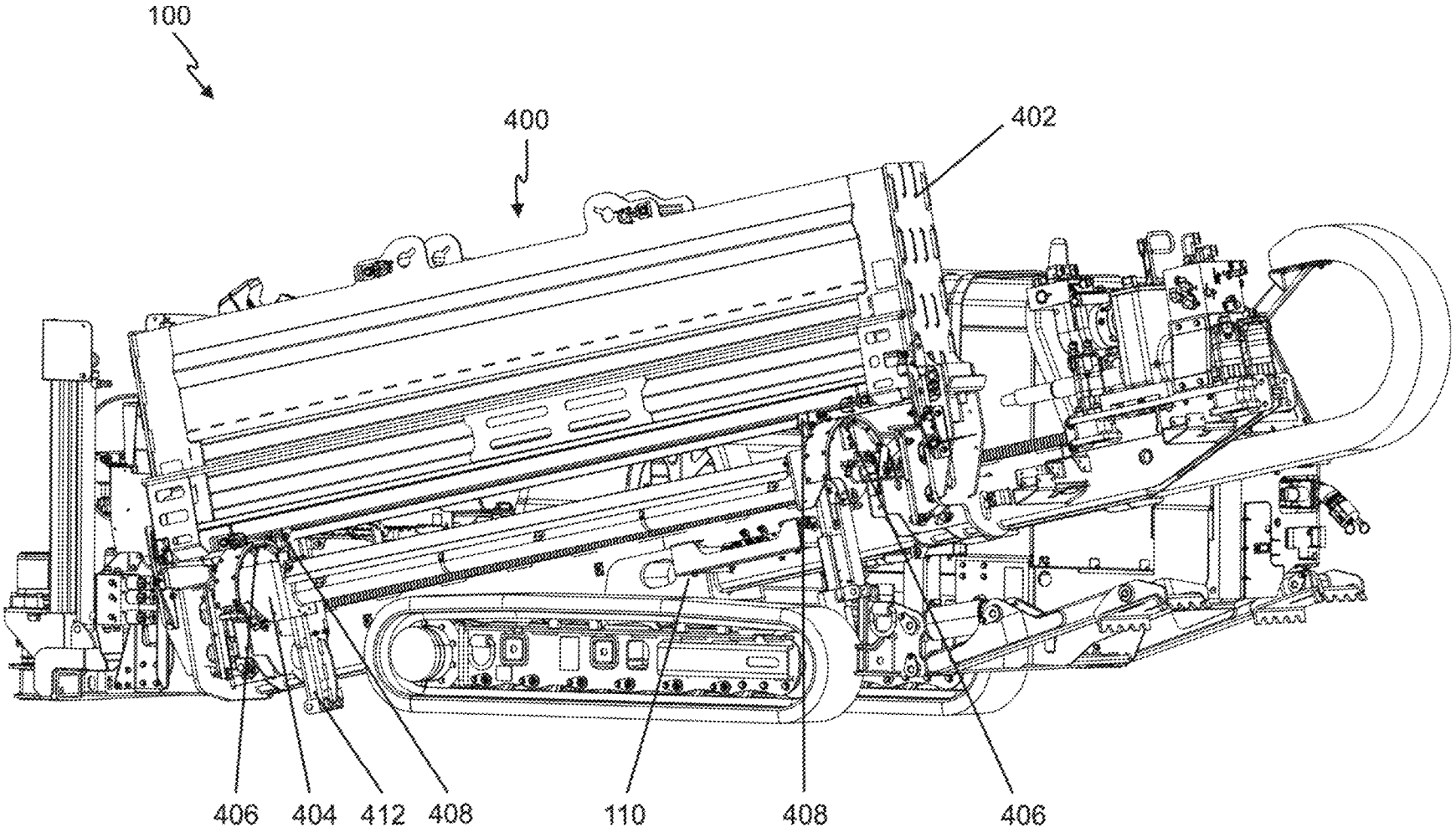
FIG. 4 is a side perspective view of drill of FIG. 1, illustrating the pipe loading assembly.
Figure 5:
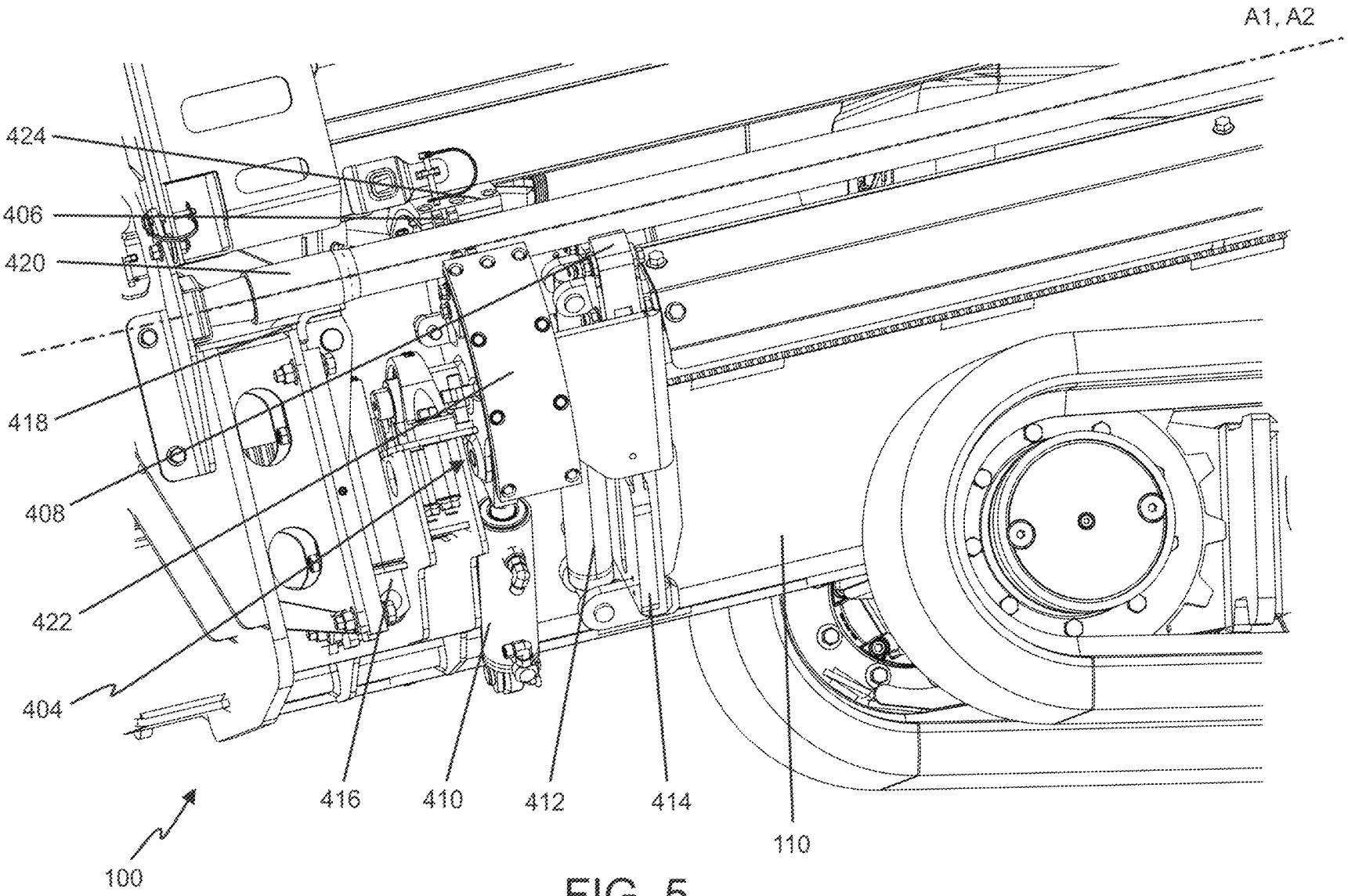
FIG. 5 is an enlarged, partial perspective view of the pipe loading assembly of FIG. 4.

FIGS. 4 & 5 are side perspective views of drill 100, illustrating the pipe loading assembly 400, operably connected to frame 110, which comprises a pipe rack 402 and a pipe loading frame 404. The pipe loading frame 404 may include: a first set of pipe receivers 406, each receiver 406 having a general U-shaped configuration, a primary axis A1, and configured to receive a substantially round pipe 420; a first actuator 410 comprising a first end connected to the drill frame 110 and a second end connected to the pipe loading frame 404 (e.g., pipe receiver); and a pipe loading extension 414. The pipe loading extension 414 may include a second set of pipe receivers 408, each receiver 408 having a general U-shaped configuration, a primary axis A2, and configured to receive a substantially round pipe 420; and a second actuator 412 comprising a first end connected to the pipe loading frame 404 and a second end connected to the pipe loading extension 414. Arcuate surfaces or slides 422,424 are adjacent to, and extend away from, each of the receivers 406. A "receiver" may refer herein to any feature adapted to receive and support a pipe 420. Examples of receivers include an aperture, an opening, a depression, a channel, a notch, a projection, a protuberance, a bump, and a ridge. Actuators 410,412 are hydraulically powered, but, alternatively, may be electrically-powered.

Figure 6A:
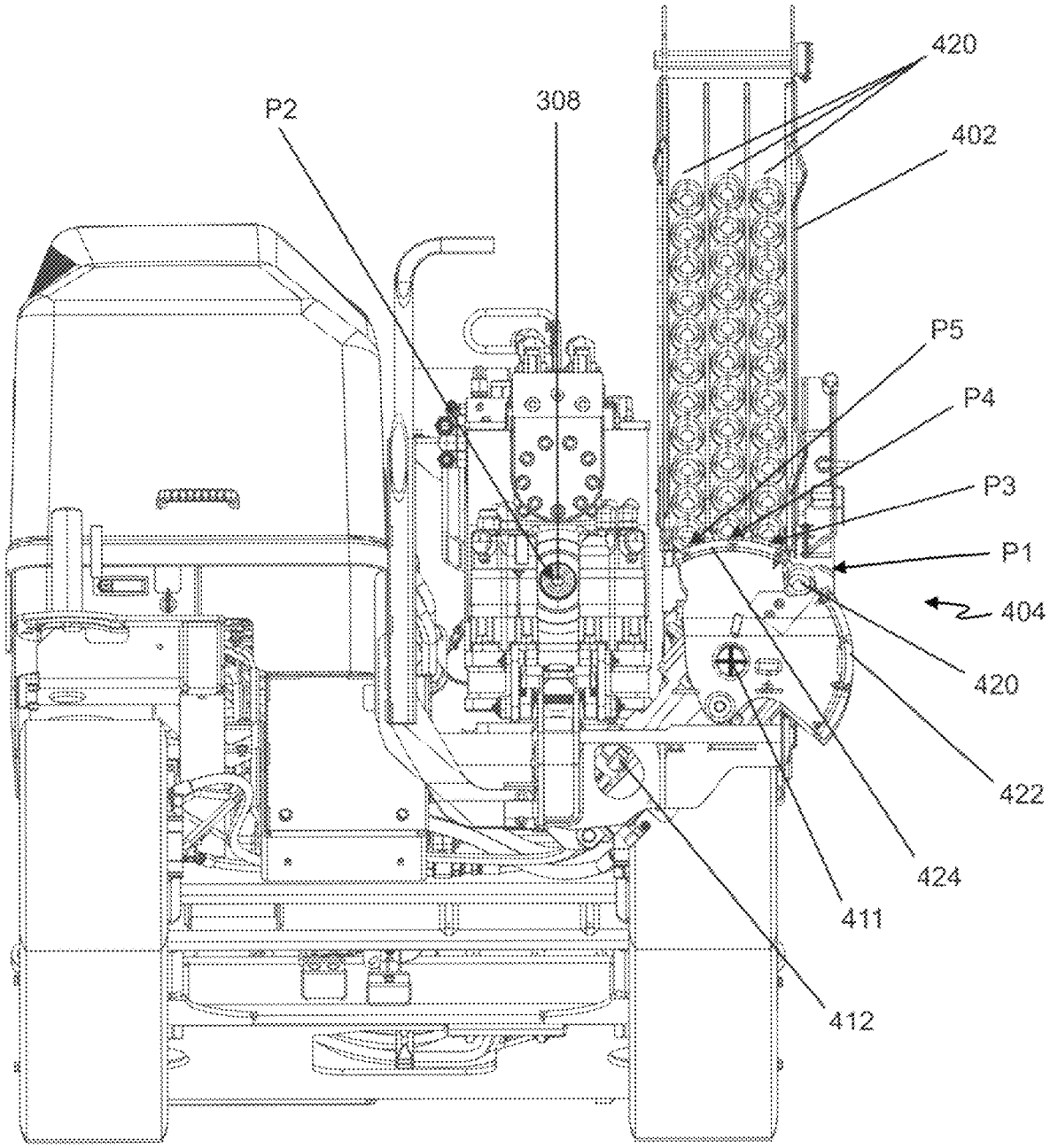
Figure 6B:
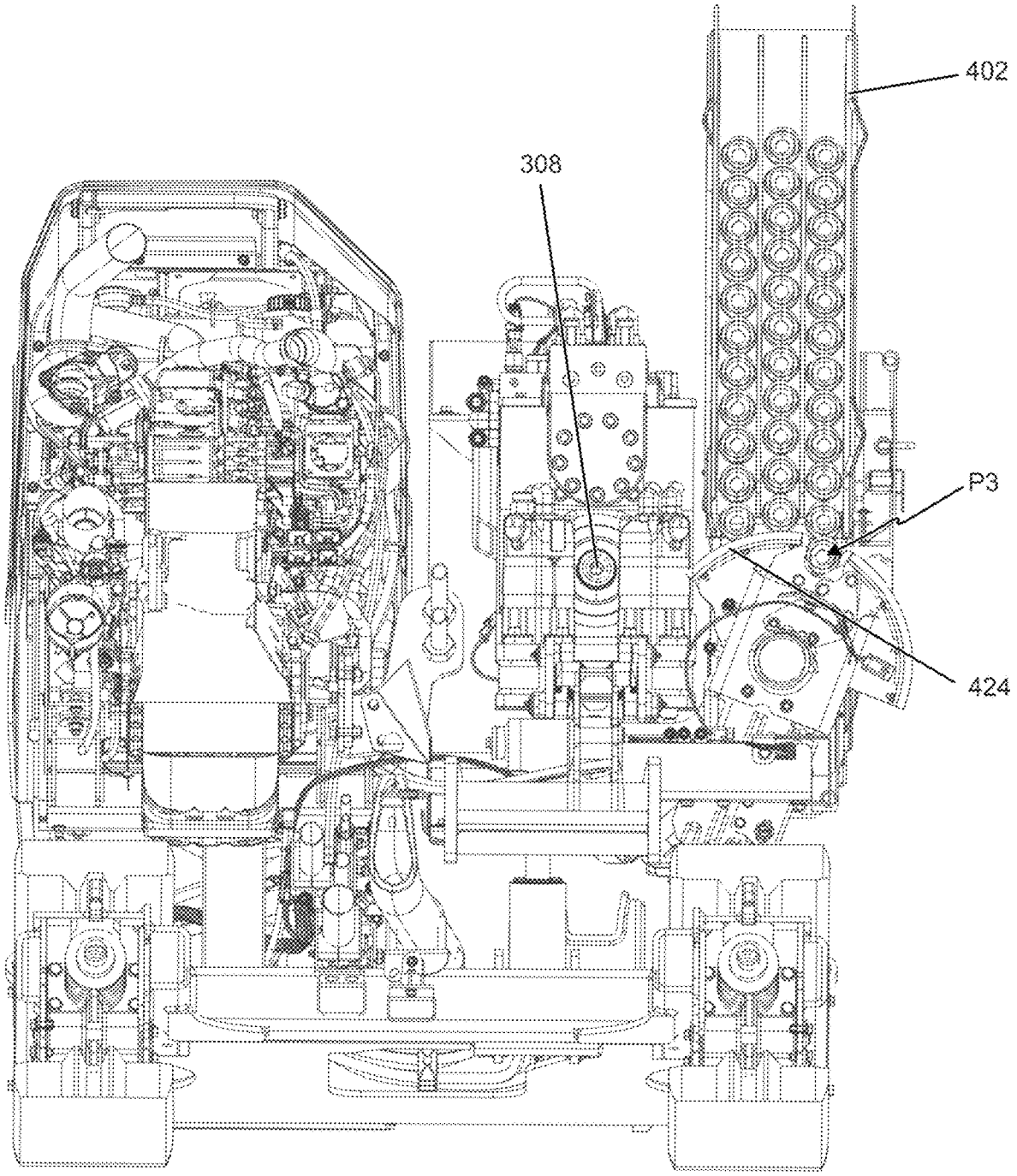
Figure 6C:
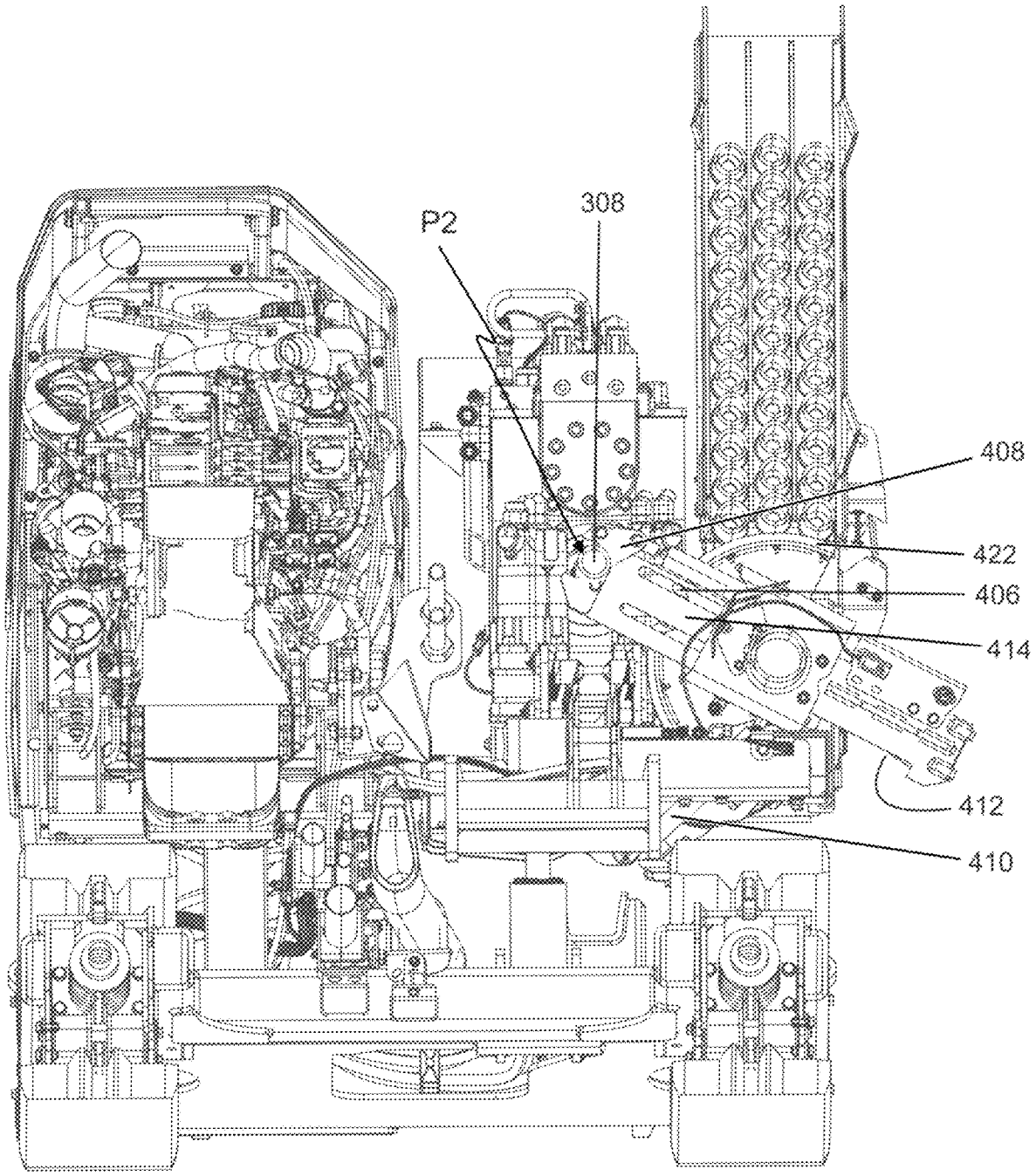

FIGS. 6A, 6B & 6C depict the pipe loading frame 404 in various positions. Pipe loading frame 404 has a first position P1 (manual loading position) configured to receive a pipe 420 (from a position outside of the pipe rack 402), from an operator, and a second position P2 (drill string position)(see FIG. 6C), wherein the pipe 420 is coaxially aligned with the drill spindle 308.

The loading frame 404 may be positioned to the manual loading position P1 through selection of manual loading mode using the mode selector 106. An operator control device receives input from an operator and outputs a signal to initiate a movement of pipe 420 via pivoting and extension of receiver 408 from first position P1 to second position P2. In one embodiment, the control device may be mode selector 106. The loading frame 404 may be brought into the manual loading position (P1) through a selection in the mode selector 106. Alternatively, mode selector 106, may further require actuation of switch 136 (see FIG. 3) to position loading frame 404 in manual loading position P1.

In position P1, the primary axes A1,A2 of receivers 406,408 are in coaxial alignment and receivers 406,408 may receive and hold pipe 420. The transition from P1 to P2 may be initiated through the mode selector 106. Alternatively, the loading frame 404 may be transitioned between P1 and P2 through actuation of remote selector switch 132 (see FIG. 1) or switch 136 (see FIG. 3). The transition of pipe loading frame 404 from P1 to P2 may begin with the first actuator 410 (see FIG. 5) rotating the pipe loading frame 404 about a longitudinal axis 411 to position the receivers 406, 408 and second actuator 412 in radial alignment with drill spindle 308. Next, the second actuator 412 may extend the pipe loading extension 414, which removes pipe 420 from contact with receivers 406, and transfers pipe 420 to drill string position P2, wherein pipe 420 is in axial alignment with the drill spindle 308. At position P2, axes of receivers 406,408 are misaligned (e.g., no longer in coaxial alignment), as receivers 406 remains at the same radial distance from axis 411 as in P1, while receivers 408 have increased their radial distance from axis 411 by way of actuator 412 extension. During the transition process from manual loading position P1 to the drill string position P2, pipe 420 may be in substantially continuous communication with the loading assembly 400. For example, receivers 408 may remain in substantially constant contact with pipe 420 from the point at which pipe 420 is loaded at P1 until pipe 420 is in coaxial alignment with drill spindle 308 at P2. In other words, a single actuation of remote selector 132, or mode selector 106, may automate the delivery of pipe 420 from P1 to P2 while maintaining continuous contact between the pipe loading frame 404 and pipe 420 as the pipe loading frame moves between the manual loading position (P1) and the drill string position (P2).

The pipe loading assembly may also move a pipe 420 from the manual loading position (first position P1) to the pipe rack 402 by translating pipe 420 to a third position P3, fourth position P4, or fifth position P5. Similar to transition of P1 to P2, transition from one position to another position may be initiated through actuation of mode selector 106, switch 132, or switch 136. A lift actuator 416 (see FIG. 5), in communication with a pipe elevator 418, is configured to translate pipe 420 up into the pipe rack 402 and allow pipe loading frame 404 to rotate back to the manual loading position P1, after which actuator 416 retracts and elevator 418 descends. The pipe loading frame 404 is then capable of receiving a second pipe 420 at manual loading position P1 and translating the second pipe 420 to the drill string position P2, while the first pipe 420 remains in the pipe rack 402. This process is possible as slides 422,424 prevent any pipe 420, which may be in the pipe rack 402 from descending out of the pipe rack 402 as actuator 410 rotates receivers 406,408, which are in contact with the second pipe 420. In other words, the surface of arcuate slides 422,424, which adjacently extend from pipe receiver 406, are configured to prevent the second pipe 420 from descending out of the pipe rack 402 during a transition of the first pipe from the manual loading position to the drill string position. Furthermore, pipe loading frame 404 is configured to receive a pipe 420 from positions P1,P3,P4,P5 and deliver to position P2 while maintaining substantially continuous contact between pipe 420 and loading frame 404.

Figure 7:
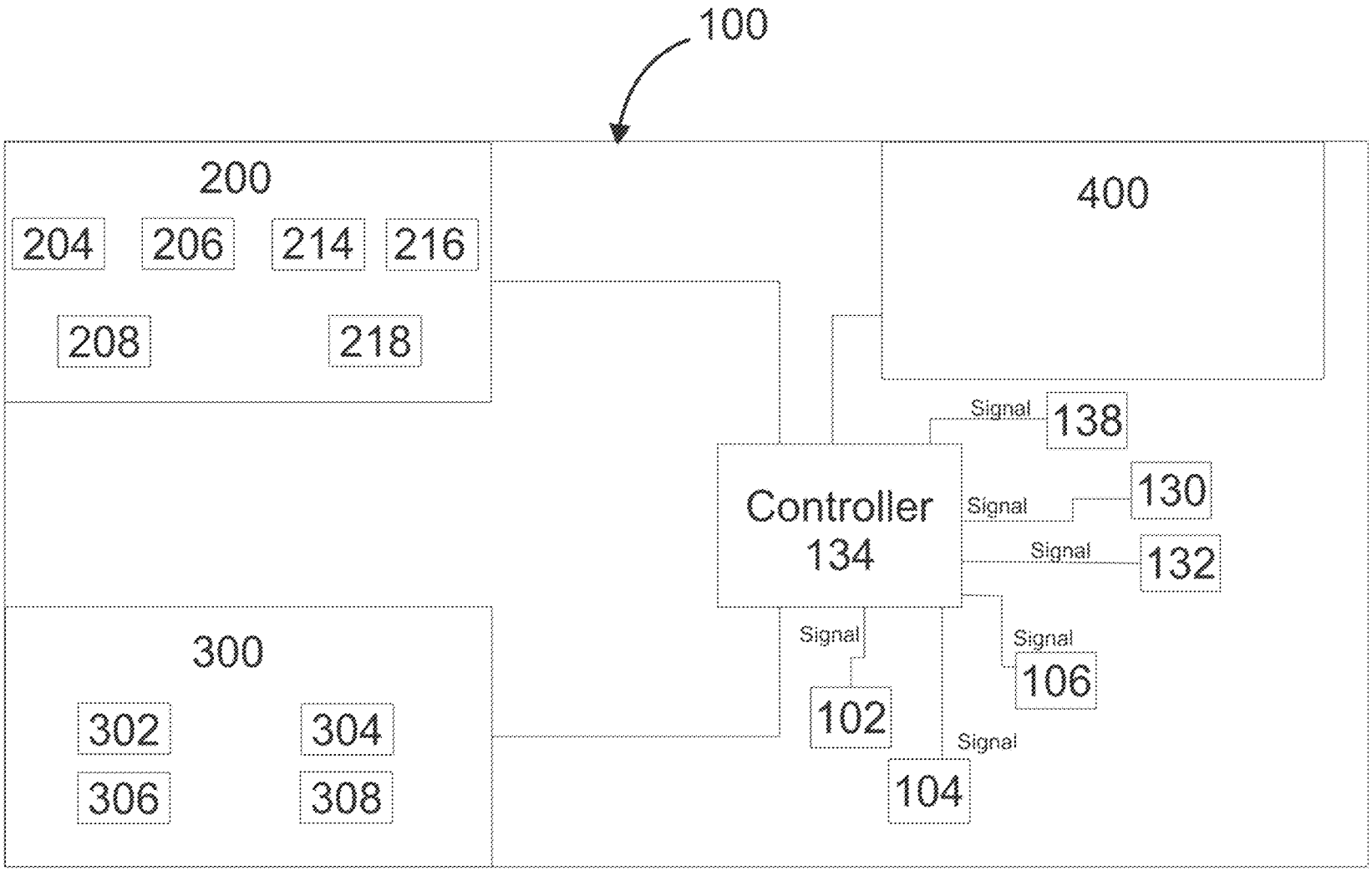
FIG. 7 is a schematic representation of the drill of FIG. 1.

FIG. 7 depicts a schematic representation of drill 100. Signals (represented by lines) may be received by controller 134, interpreted (as described above), and a corresponding signal may be sent out to the anchor assembly 200, the drill carriage assembly 300, pipe loading assembly 400 or mode selector 106. As stated above, controller 134 may physically reside within mode selector 106, while maintaining the signal schematic relationship depicted in FIG. 7.

While described with reference to specific embodiments herein, those of skill in the art will recognize that other embodiments are possible. For example, the features of input devices 102,104 may be exchanged.

In addition, embodiments of the above disclosure may find applications to other construction equipment which requires additional stabilizing pads or anchors, in which joysticks are utilized to control the main function of the equipment, for example: aerial work platforms; cranes; and backhoes.

Illustrative embodiments are described and reference has been made to possible variations of the same. These and other variations, combinations, and modifications will be apparent to those skilled in the art, and it should be understood that the claims are not limited to the illustrative embodiments set forth herein.

What is claimed is:

1. An underground directional drill comprising:

a frame;

a drill spindle operably connected to the frame;

a pipe rack operably connected to the frame; and a pipe loading frame operably connected to the frame, wherein the pipe loading frame is movable between a manual loading position and a drill string position, and wherein a pipe positioned within the pipe loading frame maintains continuous contact with the pipe loading frame during movement of the pipe loading frame between the manual loading position and the drill string position, the pipe loading frame further comprising:

a first pipe receiver; and a second pipe receiver, the first pipe receiver and the second pipe receiver each defining a primary axis, wherein the primary axes of the first and second pipe receivers are coaxially aligned when the pipe loading frame is in the manual loading position, and are coaxially misaligned when the pipe loading frame is in the drill string position, wherein the pipe loading frame, when in the manual loading position, is adapted to receive the pipe from a position outside of the pipe rack, and when in the drill string position, is adapted to position the pipe in coaxial alignment with the drill spindle.

2. The underground directional drill of claim 1, wherein a singular actuation of a switch associated with the drill causes the pipe loading frame to move between the manual loading position and the drill string position while maintaining the continuous contact between the pipe loading frame and the pipe.

3. The underground directional drill of claim 1, further comprising a second pipe located in the pipe rack.

4. The underground directional drill of claim 3, wherein the pipe loading frame comprises an arcuate slide adjacent to, and extending away from, the first pipe receiver, the arcuate slide adapted to prevent the second pipe from descending out of the pipe rack during movement of the pipe loading frame from the manual loading position to the drill string position.

5. The underground directional drill of claim 1, further comprising a first actuator connected to the frame and to the pipe loading frame, the first actuator configured to rotate the pipe loading frame to position the first and second receivers in radial alignment with the drill spindle.

6. The underground directional drill of claim 5, further comprising a second actuator connected to the pipe loading frame, the second actuator adapted to move the pipe radially toward the drill spindle.

* * * * *